US005657821A

United States Patent [19]

Beauquin et al.

[11] Patent Number: 5,657,821

[45] Date of Patent: Aug. 19, 1997

[54] FACILITY FOR AN OIL WELL

[75] Inventors: Jean-Louis Beauquin, Saint Faust; Pierre Lemetayer, Pau, both of France

[73] Assignee: Elf Aquitaine Production, France

[21] Appl. No.: 509,572

[22] Filed: Jul. 31, 1995

[30] Foreign Application Priority Data

Jul. 29, 1994 [FR] France ..... 94 09455

[51] Int. Cl.[6] ..... E21B 43/18

[52] U.S. Cl. ..... 166/68; 166/97.5; 166/106

[58] Field of Search ..... 166/68, 68.5, 106, 166/370, 372, 67, 97.5, 369, 90.1, 91.1

[56] References Cited

U.S. PATENT DOCUMENTS

| | | | |
|---|---|---|---|
| 1,431,779 | 10/1922 | Conrader | 166/68 |
| 2,227,538 | 1/1941 | Dorton | 166/372 |
| 2,580,332 | 12/1951 | Teetor | 166/106 X |
| 2,850,099 | 9/1958 | Brown | 166/97.5 |
| 3,399,623 | 9/1968 | Creed | 166/302 |
| 3,746,089 | 7/1973 | Vencil | 166/106 |
| 3,765,483 | 10/1973 | Vencil | 166/265 |
| 3,980,138 | 9/1976 | Knopik | 166/372 |
| 4,266,607 | 5/1981 | Halstead | 166/244 |
| 4,296,814 | 10/1981 | Stalder et al. | 166/303 |
| 4,345,647 | 8/1982 | Carmichael | 166/68.5 |
| 4,390,061 | 6/1983 | Short | 166/372 X |
| 4,832,127 | 5/1989 | Thomas et al. | 166/369 |
| 4,878,539 | 11/1989 | Anders | 166/373 X |
| 5,289,881 | 3/1994 | Schuh | 166/303 |
| 5,450,901 | 9/1995 | Ellwood | 166/67 X |

*Primary Examiner*—Hoang C. Dang
*Attorney, Agent, or Firm*—Bacon & Thomas

[57] ABSTRACT

A facility for an oil well, extending from the surface (12) towards an oil-bearing rock stratum (14), includes a first casing (20) placed in the well and forming a flow way towards the surface for the hydrocarbons originating from the oil-bearing rock stratum (14). According to the invention the well receives a second casing (22) forming a second flow way towards the surface for the hydrocarbons originating from the same rock stratum, the facility additionally including a chamber (51) between the casings (20,22) and the well wall (18), which does not contain any hydrocarbons originating from the rock stratum.

5 Claims, 1 Drawing Sheet

FACILITY FOR AN OIL WELL

BACKGROUND OF THE INVENTION

1. Field of the Invention

The present invention relates to a facility for an oil well and more particularly, but not exclusively, to a facility for an activated oil well, in which well the flow of the hydrocarbons from the bottom to the surface is assisted, temporarily or continuously by a means of activation, for example a pump whose delivery is placed at the bottom of the well.

2. Description of Related Art

In some oil wells the natural flow of the hydrocarbons from the bottom to the surface is found to be insufficient to permit or maintain commercial production. This is due either to the high viscosity of the hydrocarbons or to a very low natural pressure at the bottom of the well or else to a combination of both. To make it possible to bring the well into production on a commercial scale it is possible to employ an assistance system or a well activation system. For example, it is possible to place a pump at the lower end of a production tubing situated in the well. This pump, provided with an electrical motor immersed at the bottom of the well and powered by a cable placed in the annular space between the casing and the well casing, conveys hydrocarbons under pressure from the bottom to the surface. The power cable of the electrical motor, as well as the connections at each of its ends, run in an attacking, and frequently hot and corrosive medium, and are subjected to large variations in gas pressure and thus are subject to rapid deterioration. The replacement of this electrical equipment is a costly operation which additionally involves production losses during the stoppage in well operation.

The use of an electrical motor at the bottom of a well presents other disadvantages where the power cable is concerned because it requires high-grade leakproofing at the point where the cable enters a part of the well in contact with the effluents emanating from the oil-bearing rock, or passes through the wellhead unit placed at the surface. This leakproofing, which is difficult to achieve, is often the cause of short circuits which damage the plant and make it inoperative.

In addition, in a facility of this type, in which a single casing is installed, the operation is often handicapped by the presence of gas which it may be necessary to separate from the liquids and to convey via the annular space.

SUMMARY OF THE INVENTION

The subject of the present invention is a facility for an oil well offering an enhanced flexibility in the control of the flow of hydrocarbons and which makes it possible to define, in the well, a chamber which is isolated from the hydrocarbons originating from the well bottom.

To do this, the invention proposes a facility for an oil well extending from the surface towards an oil-bearing rock stratum, including a first casing placed in the well and forming a flow way towards the surface for the hydrocarbons originating from the oil-bearing rock stratum, characterized in that it includes a second casing placed in the well and forming a second flow way towards the surface for the hydrocarbons originating from the same rock stratum, the facility additionally including a chamber between the casings and the well wall, which does not contain any hydrocarbons originating from the rock stratum.

According to a second aspect of the invention, the second casing is provided with an electrical pump a large proportion of whose power cable runs in the chamber.

Other characteristics and advantages of the present invention will emerge more clearly on reading the description given below with reference to the attached drawings.

DETAILED DESCRIPTION OF THE INVENTION

Figures 1A, 1B:
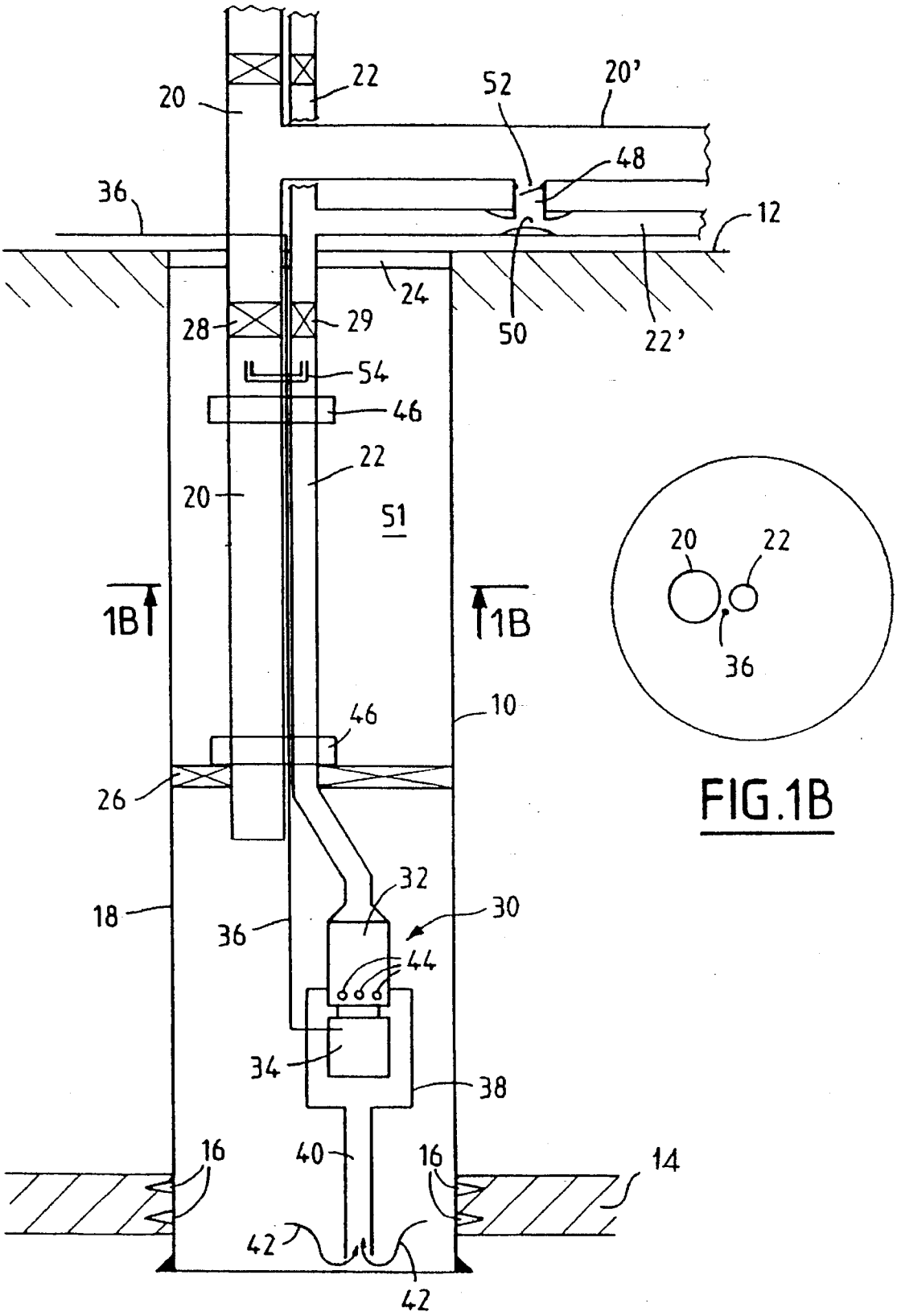
FIG. 1A is a diagrammatic sectional view of an activated oil well according to the invention.
FIG. 1B is a section taken along the line 1B—1B of FIG. 1A.

As shown in FIG. 1, an oil well 10 extends between the surface 12 and an oil-bearing rock stratum 14. The well is provided with perforations 16 opening into the oil-bearing rock, which allow hydrocarbons to flow towards the interior of the well 10. The well 10 comprises a well casing 18 which renders the well leak-proof in relation to the rock strata through which the well passes.

Inside the well 10 there run two production casings 20 and 22 which may be of different diameters. In the example illustrated the casings 20 and 22 run in parallel, but the casings may be placed concentrically, one inside the other. The first casing 20 runs between a wellhead, shown diagrammatically at 24, and a seal 26, more commonly called a "packer", placed, for example, approximately 100 m above the level of the oil-bearing rock 14. The first casing 20 is optionally provided with a safety valve 28 towards its upper end, for example 50 m from the ground. The second casing 22, also supported by the wellhead and optionally provided with a safety valve 29, runs parallel to the first casing 20 and immediately adjacent to the latter. The diameter of the second casing 22 is preferably smaller than that of the first casing 20.

Towards its lower end, the second casing 22 comprises a pumping unit, represented generally by 30, which includes a pump 32 driven in rotation by an electrical motor 34. The electrical motor 34 is powered by an electrical cable 36 placed outside the casings 20, 22. The cable 36 preferably runs in the vicinity of the two casings 20, 22, as shown in FIG. 1B, being thus protected from mechanical impacts that may occur during well repair operations.

In the example illustrated, the electrical motor is surrounded by a jacket 38 provided with a tubular extension 40 which extends to a level below the perforations 16. The function of the pump is to draw in the heaviest hydrocarbons, since the lightest ones tend to rise naturally via the casing 20. The two casings 20 and 22 are integrally connected by joints 46.

The facility for an oil well which is thus described can be put into production in a number of ways.

In the case of a well which is at least weakly eruptive, a first fraction of the hydrocarbons, which is light because it comprises a large quantity of gas, passes through the first casing 20 which, being of large diameter, promotes the natural flow of the hydrocarbons with minimum friction.

The heaviest hydrocarbons, originating from the oil-bearing rock, follow a path represented by arrows 42 towards the tubular part 40 which communicates with entries 44 of the pump 32. This path comprises a downward flow section which promotes the removal by gravity of the free gas present in the liquid, owing to a difference in phase density. The flow of the liquid hydrocarbons around the motor 34 before they reach the pump 32 provides the motor with cooling.

At the surface 12, beyond the wellhead 24, the casings 20 and 22 fork, forming conduits 20' and 22' respectively. The conduits 20' and 22' are connected by a conduit 48 which opens inside a venturi 50 placed in the conduit 22' and the purpose of which is to reinforce the induction of the light hydrocarbons into the conduit 22'. The conduit 48 is provided with a nonreturn valve 52. The venturi 50 is preferably adjustable. This assembly can also be fitted in the well, before the forking, at a depth determined as a function of the optimum hydraulic conditions and especially under the seal 26 if it is desired to save a double wellhead and a casing in the upper part. In this case this assembly can be installed or replaced using a lightweight operation, for example with the aid of a cable.

The flow of the second fraction in the conduit 22' through the venturi 50 creates a pressure reduction which reinforces the induction of the first fraction flowing in the conduit 20'. Partly for this reason, and because it reduces the pressure at the bottom of the well, the pumping, or another method of flow of the second fraction in the conduit 22', is used to increase the flow capacity of the first fraction in the conduit 20'. It is thus possible to control the flow rate in the first conduit, for example by varying the flow rate in the casing 22.

According to another aspect of the invention, the space outside the casings 20,22 in the well casing 18 between the seal 26 and the wellhead 24 forms a chamber 51 which is filled with a chemically inert product which, in a preferred embodiment, is a gel that is a good thermal insulator, intended to reduce thermal convection in the chamber 51. The electrical cable 36 and the hydraulic lines (not shown) leading to the safety valves 28,29 thus run in a noncorrosive medium, which considerably lengthens their lifetime. Only the final section of the electrical cable, running between the seal 26 and the motor 34, is in a corrosive medium. Bearing in mind its small length, this section can be protected by more costly protective means, for example by placing it in a reinforced or armoured metal sheath.

The casings 20 and 22 are connected to one another upstream of the safety valves 28,29 at one or more points by means of hydraulic conduits shown diagrammatically at 54, provided with a control valve (not shown) which can be interchanged by cable from the surface. These hydraulic conduits can advantageously be incorporated into a joint 46 integrally connecting the two casings.

Installing the two casings 20 and 22 in the well 10 also offers the possibility of assisting the flow of the hydrocarbons by injection of gas towards the bottom of the well in order to lighten the hydrocarbon column. This gas injection, more commonly called a "gas-lift", is preferably performed via the smaller-diameter casing 22 in order to make the hydrocarbons flow through the larger-diameter casing 20. The gas can also be injected from the casing 20 towards the casing 22 in order to reduce the stress on the pump in operation.

Both techniques can be employed simultaneously.

These two "gas-lift" possibilities also constitute optional resources or relay activation systems avoiding considerable production losses if a stoppage is necessary to replace the pump when the latter does not function or else if the effluent originating from the rock changes in characteristics (more gas or more water) and renders the pump in place unsuitable.

The facility according to the invention permits numerous pinpoint operations simultaneous with the pumping, providing access to the bottom of the well with the aid of equipment suspended from the cable, such as measurements of bottom parameters, for example flow rate, temperature or pressures.

The facility also makes it possible to perform perforations while the pressure at the bottom of the well is reduced with the pump, which has the advantage of promoting the removal of the debris from firings and therefore improving the permeability of the holes thus produced in the well casing. The perforating gun is lowered by cable via the second casing.

We claim:

1. Facility for an oil well extending from the surface towards an oil-bearing rock stratum comprising a first casing placed in the well and forming a flow way towards the surface for the hydrocarbons originating from the oil-bearing rock stratum, a second casing placed in the well and forming a second flow way towards the surface for the hydrocarbons originating from the same rock stratum, and a chamber between the casings and the well wall, which does not contain any hydrocarbons originating from the rock stratum, wherein the casings communicate with each other at a point at the surface or inside the well and said communication between the casings is formed by a conduit which opens into the second casing inside a venturi placed in the second casing.

2. Facility according to claim 1, wherein the second casing is provided with an electrical pump a large proportion of whose power cable runs in the chamber.

3. Facility according to claim 1, wherein the chamber is filled with an inert product.

4. Facility according to claim 3, wherein the inert product is a gel that is a good thermal insulator.

5. Facility according to claim 1, wherein the first casing receives the lightest fraction of hydrocarbons and the second casing receives the heaviest fraction of hydrocarbons.

* * * * *